United States Patent [19]

Vollmar

[11] Patent Number: 4,476,795

[45] Date of Patent: Oct. 16, 1984

[54] REVERSIBLE FEED MECHANISM FOR SEWING MACHINES

[75] Inventor: Kurt Vollmar, Weilerbach, Fed. Rep. of Germany

[73] Assignee: Pfaff Industriemaschinen GmbH, Fed. Rep. of Germany

[21] Appl. No.: 473,143

[22] Filed: Mar. 7, 1983

[30] Foreign Application Priority Data

Mar. 18, 1982 [DE] Fed. Rep. of Germany ..... 3209896

[51] Int. Cl.[3] ..... D05B 27/22

[52] U.S. Cl. ..... 112/316

[58] Field of Search ..... 112/316, 317

[56] References Cited

U.S. PATENT DOCUMENTS

| | | | |
|---|---|---|---|
| 1,731,080 | 10/1929 | Moffatt | 112/316 |
| 4,143,608 | 3/1979 | Coulombe | 112/316 |
| 4,183,314 | 1/1980 | Sato | 112/316 |
| 4,271,776 | 6/1981 | Landwehor | 112/316 X |

*Primary Examiner*—Werner H. Schroeder
*Assistant Examiner*—Andrew M. Falik
*Attorney, Agent, or Firm*—McGlew and Tuttle

[57] ABSTRACT

A setting mechanism for the feed dog of a sewing machine having a setting member secured to a setting shaft for determining the amount and direction of the feed movement for the feed dog, comprises a reversal lever which is pivotable between two end positions and biased into one of the end positions by a return spring. To be able to vary the setting torque by which the return spring opposes the setting motion of the reversal lever, the other end of the return spring is connected to the reversal lever through a linkage. This linkage includes an end member having its pivotal axis coaxial with the setting shaft. The torque of the return spring, which normally increases with the progressing pivoting of the reversal lever may be reduced by a linkage design wherein the torque acting on the reversal lever through this linkage reverses within the actuating range of the lever.

10 Claims, 5 Drawing Figures

REVERSIBLE FEED MECHANISM FOR SEWING MACHINES

FIELD AND BACKGROUND OF THE INVENTION

The present invention relates, in general, to sewing machines and in particular to a new and useful setting mechanism for a feed dog of a sewing machine.

Such setting mechanisms are actuated against the opposing force of a return spring having one end secured to the sewing machine housing. This return force must exceed the reversing forces which are caused at the stitching mechanism by the feed motion of the feed dog and which, as is well known, reach a maximum with the setting of the maximum stitch length and at the maximum speed of the sewing machine. Therefore, to obtain a completely satisfactory result of the sewing operation, the return spring must have a sufficient initial bias already at the time the stitch is set. While actuating the reversal level, to set the opposite feed direction, the spring force increases in proportion to the deflection of the lever, so that a considerable actuating force must be exerted by the operator.

SUMMARY OF THE INVENTION

The present invention is directed to a setting mechanism in which the force needed for and during the actuation, increases at a slower rate than does the force of the return spring.

Accordingly, an object of the present invention is to provide a setting mechanism for the feed dog of a sewing machine having a setting member secured to a setting shaft for determining an amount and direction of feed motion for the feed dog, a reversal lever which is pivotable into two end positions and connected through a first linkage to the setting shaft, and being biased into one of its end positions by a return spring which acts, at one end of the return spring, on the first linkage, and a second linkage connected to an opposite end of the return spring for varying a setting torque amount of the return spring to be overcome while pivoting the reversal lever.

Due to this provision, the actuating force ceases to be solely a function of the varying opposite force of the return spring, and the characteristic of the setting force acting on the reversal lever can, to a large extent, be varied by a suitable design of the linkages between the return spring and the reverse lever.

Depending on the design of the two linkages, the two components of the spring force transmitted through these linkages, will affect each other in different ways.

A further object of the invention is to provide such a setting mechanism wherein the second linkage is structured so that the setting torque for the return spring acting on the reversal lever, reverses its acting direction within the pivoting range of the reversal lever.

The actuating force to be exerted during the reversal may thus be rendered to an extent satisfactory for locking.

A still further object of the invention is to provide a setting mechanism for the feed dog of a sewing machine which is simple in design, rugged in construction and economical to manufacture.

For an understanding of the principles of the invention, reference is made to the following description of a typical embodiment thereof as illustrated in the accompanying drawings.

BRIEF DESCRIPTION OF THE DRAWINGS

One embodiment of the invention is shown in the drawings in which.

While a specific embodiment of the invention has been shown and described in detail to illustrate the application of the principles of the invention, it will be understood that the invention may be embodied otherwise without departing from such principles.

DESCRIPTION OF THE PREFERRED EMBODIMENT

Figures 1, 2:
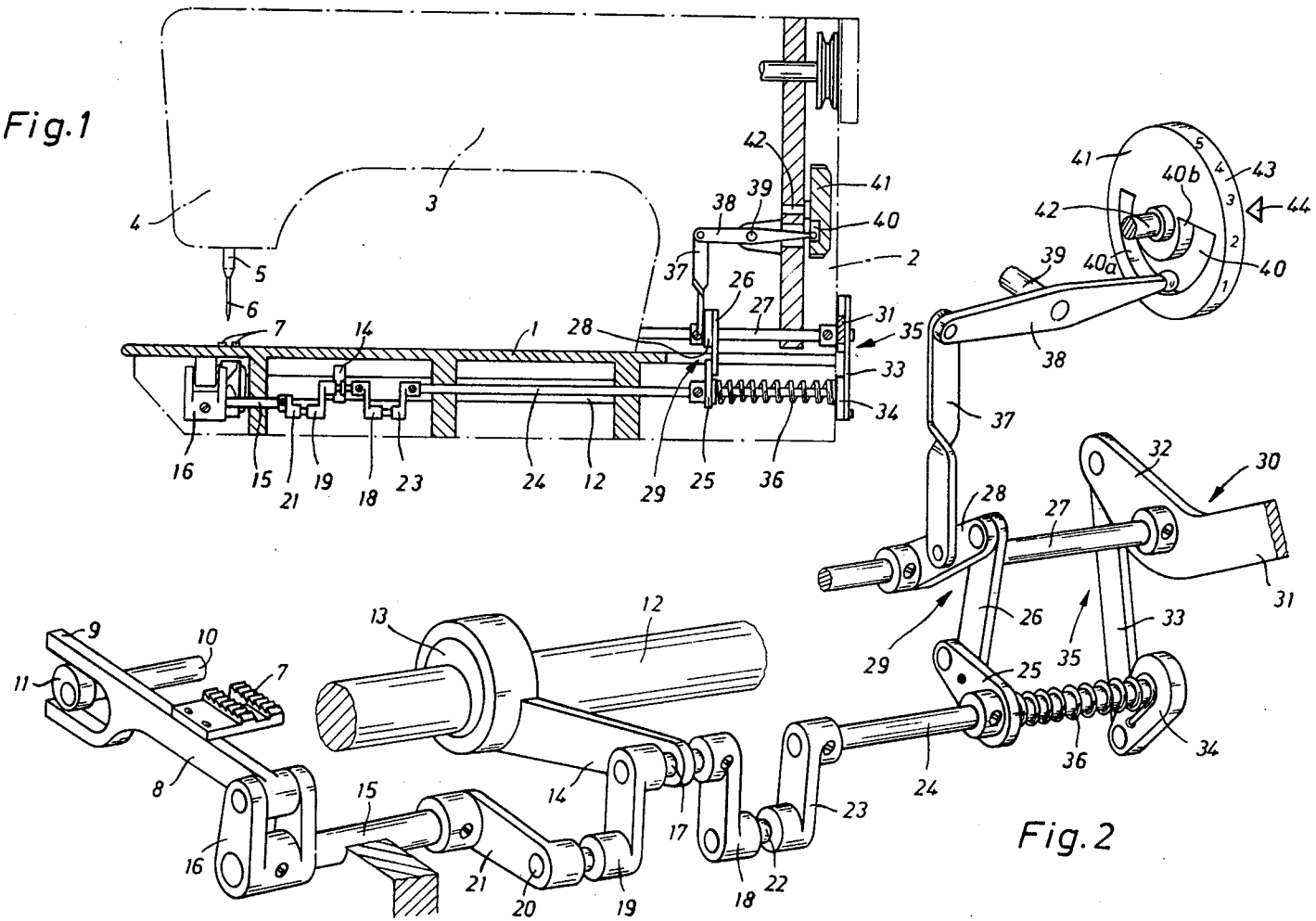
FIG. 1 is a diagrammatical front view of the sewing machine, partly in section.
FIG. 2 is a perspective view of the feed mechanism.

FIG. 1 shows a sewing machine comprising a bed plate 1, a standard 2, upper arm 3, and a head 4. Mounted in head 4 is a needle bar 5 carrying a needle 6. In a manner known per se, needle bar 5 cooperates with a rotary hook which is mounted beneath bed plate 1.

To advance the work to be sewed, a feed dog 7 is provided which is supported on a carrier 8 below bed plate 1. Carrier has a forked end 9 engaging over an eccentric 11 which is secured to a shaft 10. Shaft 10 is driven in a manner known per se, to impart up and down movement to feed dog 7.

A shaft 12 extending parallel to shaft 10 is mounted for rotation and carries an eccentric 13 which is embraced by an eccentric rod 14.

Another shaft 15 extends parallel to shaft 12 and carries a forked lever 16 which is firmly secured thereto and hinged to carrier 8.

The free end of eccentric rod 14 is hinged to a bolt 17 which is firmly secured to a link 18 and rotatably connected to a link 19. Link 19 is hinged through a pin 20 to a lever 21 which is firmly secured to shaft 15, while link 18 is hinged through a pin 22 to a setting member 23 which is secured to a setting shaft 24.

Setting shaft 24 carries a lever arm 25 which is firmly secured thereto and connected through a link 26 to a lever arm 28 which is firmly secured to a shaft 27. Shaft 27 is mounted for rotation in standard 2 of the sewing machine. Parts 24 to 28 form a linkage 29. Firmly screwed to shaft 27 is a reversal lever 30 comprising a grip 31 and a lever arm 32. Reversal lever 30 is pivotable into two end positions which are determined by stop elements, on standard 2 for example. Lever arm 32 is hinged through a coupling member 33 to a lever arm 34 which is loosely mounted on shaft 24. Parts 27, 32 to 34 and 24 form a second linkage 35. Lever arm 34 acts as end member for linkage 35. The ends of a return spring 36 surrounding shaft 24 are attached to lever arms 25 and 34, respectively.

Lever arm 28 is connected through a link 37 to one arm of a lever arm 38 which is secured to a shaft 39 connected to standard 2 of the sewing machine. The other arm of lever 38 engages a groove 40 of a setting disc or element 41 which is secured to a shaft 42 that also is mounted in standard 2. Groove 40 has boundary walls **40*a* and 40*b*. Wall 40*a*** determines the adjustable feed length of dog 7 in the forward direction, while wall 40*b* determines the adjustable feed length in the rearward direction. Setting disc 41 is provided with a graduation 43 cooperating with a suitable mark 44 provided on standard 2 of the sewing machine.

The mechanism operates as follows:

The feed length of feed dog 7 is varied by turning setting disc 41 whereby, under the effect of return spring 36, setting shaft 24 turns along and lever 38, which is linked to shaft 24 through hinges, is held in contact with wall 40*a* of groove 40, for adjusting the feed length in the forward direction. While turning, setting shaft 24 takes along setting member 23 and displaces pin 22, forming the axis of rotation of link 18, relative to pin 20. Therefore, as bolt 17 is moved by eccentric rod 14 in oscillatory motion, link 18 executes a pure rotary motion about pin 22, while link 19 executes, in addition to this rotary motion, a relative motion about shaft 15. This relative motion is transmitted by lever 21 as an oscillatory motion to lever 16 by which forward feed movements are imparted to feed dog 7 through carrier 8. The extent of these forward feed movements depends on the position of setting disc 41 thus on the angular displacement of setting member 23 relative to the zero position thereof, which is the position of alignment of pins 20 and 22. The set feed length can be read on graduation 43 by means of mark 44.

Figure 3:
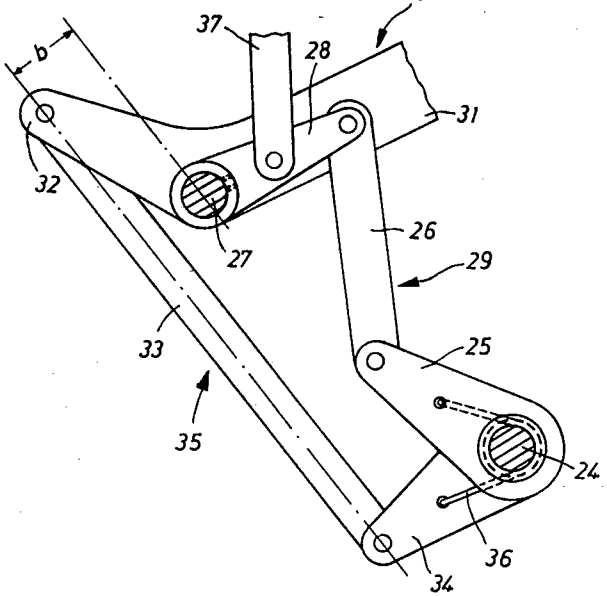

With the rotation of setting shaft 24 through return spring 36 as described in the foregoing, the spring force transmitted through linkage 29 (lever arm 25, link 26, and lever arm 28) causes an upward motion of the free end of reversal lever 30 (FIG. 3). Simultaneously, in its position shown in FIG. 3, return spring 36 effects an also upward pivotal motion of reversal lever 30 through linkage 35 (lever arm 34, coupling member 33, and lever arm 32). While pushing reversal lever 30 down, in order to reverse the sewing direction, lever 38 is pivoted, through shaft 27, lever arm 28, and link 37, into contact with wall 40*b* of groove 40. At the same time, through lever arm 28, link 46 and lever arm 25, setting shaft 24 is turned into a position in which linkage 15 to 23 imparts rearward feed movements to feed dog 7.

Figure 4:
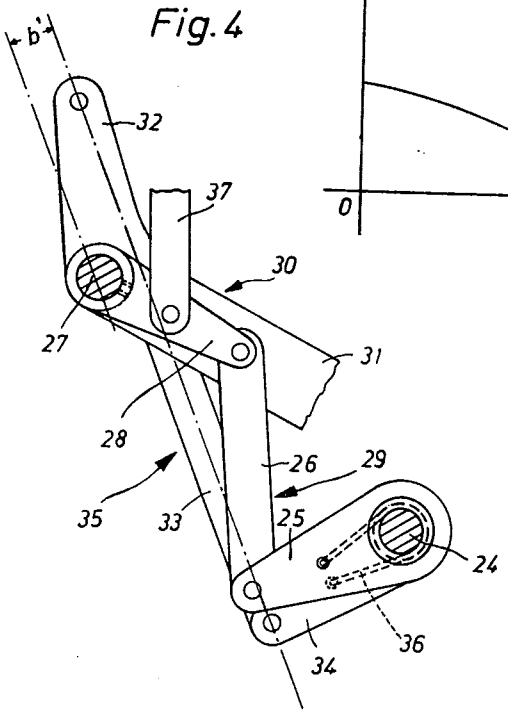
FIGS. 3 and 4 are side views, in different setting positions, of the two linkages which are connected to the reversal lever of the setting mechanism.

While pushing reversal lever 30 from its position shown in FIG. 3 into its position shown in FIG. 4, lever arm 25 is pivoted through linkage 29 counterclockwise. Simultaneously, through linkage 35, lever arm 34 is pivoted clockwise. This pivoting of the two lever arms 25 and 34 tensions return spring 36. The total return force of the spring 35 is uniformly transmitted to both linkages 29 and 35. However, upon pivoting reversal lever 30 from its end position shown in FIG. 3, through an angle $\phi$, the force component acting on lever 30 through linkage 29 increases slightly in accordance with curve A of FIG. 5, while the force component acting on lever 30 through linkage 35 decreases in accordance with curve B of FIG. 5, and is then reversed, to increase strongly in the other direction.

As may be learned from FIGS. 3 and 4, the effective lever arm b of the force component to be transmitted by coupling member 33 decreases while pivoting lever 30 moves from its position of FIG. 3 into its position shown in FIG. 4. As the axis of coupling member 33 passes through the axis of shaft 27, this effective lever arm becomes zero, to increase again to a magnitude b′ upon a further pivoting of lever 30 into the position shown in FIG. 4. Due to this rapid decrease of the effective lever arm b to zero and following rapid increase to b′, with a simultaneous reversal of the direction in which the force component acts on lever 30, the actuating force to be supplied by the operator while pushing lever 30 down is substantially reduced or modified.

Figure 5:
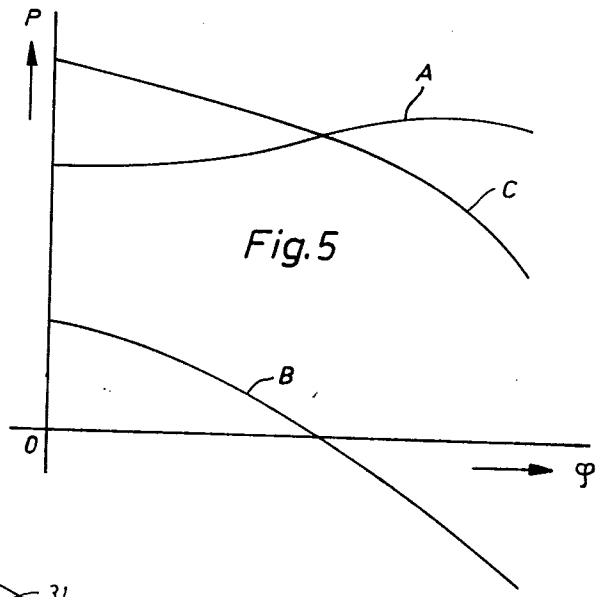
FIG. 5 is a diagram showing the variation of the force components of the return spring acting on the reversal lever during the pivotal motion thereof.

Within the pivotal range of lever 30 shown in FIG. 4, the force component represented by curve B in FIG. 5 acts in a direction opposite to the respective force component represented by curve A. The two associated force components of A and B add to the actuating force represented by curve C which, as clearly shown in FIG. 5, tends to decrease during the actuation of lever 30. This means that while pushing lever 30 down, the actuating force needed therefore slowly decreases, starting from a definite initial force. Inversely, while returning lever 30 into the upper position thereof, the actuating force to be exerted thereon increases.

Depending on the design and mutual association of the two linkages, the actuating force varies differently. Thus, in spite of the increasing tension of return spring 36 in the course of actuating reversal lever 30, the actuating force may decrease, or remain substantially the same, or increase less than with the normal tension of return spring 36. In this way, the actuating force can be adapted to the requirements of the machine operation by selecting the proper design and dimensions of the linkages.

While a specific embodiment of the invention has been shown and described in detail to illustrate the application of the principles of the invention, it will be understood that the invention may be embodied otherwise without departing from such principles.

What is claimed is:

1. A setting mechanism for the feed dog of a sewing machine having drive means for driving the dog to execute a feed motion, a setting shaft engaged with the drive means and rotatable to set an amount and direction of the feed motion, a setting element engaged through a first linkage with the setting shaft for moving the setting shaft to adjust the feed motion amount, a reversal lever connected to the first linkage and movable between at least two positions to move the setting shaft for reversing the direction of the feed motion, and biasing means engaged with the first linkage for biasing the reversal lever into one of its two positions, and further comprising, a second linkage connected between the reversal lever and the biasing means for varying an amount of force applied by the biasing means on the reversal lever with movement of the reversal lever.

2. A setting mechanism according to claim 1, wherein said second linkage includes a first end member mounted coaxially with the setting shaft.

3. A setting mechanism according to claim 2, wherein said second linkage comprises a lever arm attached to said reversal lever, the reversal lever being pivotable between its two end positions, and a coupling member pivotally connected between said lever arm and said end member, said coupling member positioned to move across an axis of rotation of the reversal lever so that the force exerted by the biasing means on the reversal lever, reverses an acting direction as said coupling member crosses said axis.

4. A setting mechanism according to claim 3, wherein the biasing means comprises a return spring having one end connected to said end member and an opposite end connected to the first linkage.

5. A setting mechanism for the feed dog of a sewing machine, comprising: a setting member secured through a first linkage to said setting shaft for determining the amount and direction of a feed motion for the feed dog; a reversal lever which is pivotable into two end positions, connected through said first linkage to said setting shaft, and being biased into one of said end positions by a return spring acting by one of its ends on said first linkage; and a second linkage connected to an opposite end of said return spring for varying the amount of torque from the return spring to be overcome while pivoting the reversal lever.

6. A setting mechanism according to claim 5, wherein said second linkage includes a first end member mounted coaxially with said setting shaft.

7. A setting mechanism according to claim 5 wherein said second linkage is of such a structure that said torque of said return spring acting on said reversal lever through said second linkage reverses within a pivoting range of said reversal lever.

8. A setting mechanism according to claim 5, wherein said second linkage comprises a double rocker mechanism including a coupling member, and a lever arm pivotally connected to said coupling member and rigidly joined to said reversal lever 30, said lever arm having a pivotal axis extending within a pivoting range of a straight line of motion of said coupling member.

9. A method of setting the feed motion of a feed dog in a sewing machine having a setting member secured to a setting shaft for determining an amount and direction of the feed motion, a reversal lever which is pivotable into two end positions and is connected through a first linkage to the setting shaft, the reversal lever being biased into one of its end positions by a return spring acting at one of its ends on the first linkage, and providing a second linkage connection between the reversal lever and the return spring to vary the force applied by the return spring on the reversal lever with movement of the reversal lever.

10. A method according to claim 9, including moving an element of the second linkage across an axis of rotation of the reversal lever to reverse a direction of the force exerted by the return spring of the reversal lever during pivotal movement of the reversal lever from one of its end positions to the other end position.

* * * * *